US011366421B2

(12) United States Patent
Ohashi

(10) Patent No.: US 11,366,421 B2
(45) Date of Patent: Jun. 21, 2022

(54) TONER CONTAINER CONFIGURED TO BE ATTACHABLE TO AND DETACHABLE FROM A TONER SUPPLYING PORTION AND A WASTE TONER COLLECTING PORTION IN AN IMAGE FORMING APPARATUS

(71) Applicant: KYOCERA Document Solutions Inc., Osaka (JP)

(72) Inventor: Hiroaki Ohashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/368,301

(22) Filed: Jul. 6, 2021

(65) Prior Publication Data

US 2022/0019169 A1 Jan. 20, 2022

(30) Foreign Application Priority Data

Jul. 15, 2020 (JP) ..... JP2020-121618

(51) Int. Cl.
*G03G 15/08* (2006.01)
*G03G 21/12* (2006.01)

(52) U.S. Cl.
CPC ..... *G03G 21/12* (2013.01); *G03G 15/0822* (2013.01)

(58) Field of Classification Search
CPC ..... G03G 15/0822; G03G 15/0863; G03G 15/0865; G03G 15/0867; G03G 21/12
USPC ..... 399/12, 120, 258, 262, 360
See application file for complete search history.

(56) References Cited

U.S. PATENT DOCUMENTS

| | | | | |
|---|---|---|---|---|
| 9,857,728 | B2 * | 1/2018 | Murata | G03G 15/0865 |
| 9,939,772 | B2 * | 4/2018 | Murata | G03G 15/0865 |
| 10,133,233 | B2 * | 11/2018 | Murata | G03G 15/0867 |
| 10,571,855 | B2 * | 2/2020 | Mochizuki et al. | G03G 21/1652 |

FOREIGN PATENT DOCUMENTS

JP 2010032594 A 2/2010

* cited by examiner

*Primary Examiner* — William J Royer
(74) *Attorney, Agent, or Firm* — Alleman Hall Creasman & Tuttle LLP

(57) ABSTRACT

An image forming apparatus includes: a toner supplying portion including a first attachment portion; and a waste toner collecting portion including a second attachment portion. A toner container includes a positioning member and a compatible key. The first attachment portion includes a first engaging portion configured to position the toner container to a first attachment position. The second attachment portion includes a second engaging portion configured to position the toner container to a second attachment position. The first engaging portion and the positioning member are formed in a shape that allows the toner container of a type corresponding to the first attachment portion to be selectively attached to the first attachment portion. The second engaging portion is formed in a shape that allows the positioning member to be engaged with a toner container of any one of a plurality of types.

4 Claims, 10 Drawing Sheets

TONER CONTAINER CONFIGURED TO BE ATTACHABLE TO AND DETACHABLE FROM A TONER SUPPLYING PORTION AND A WASTE TONER COLLECTING PORTION IN AN IMAGE FORMING APPARATUS

INCORPORATION BY REFERENCE

This application is based upon and claims the benefit of priority from the corresponding Japanese Patent Application No. 2020-121618 filed on Jul. 15, 2020, the entire contents of which are incorporated herein by reference.

BACKGROUND

The present disclosure relates to an image forming apparatus including an attachment portion that supports, in an attachable/detachable manner, a toner container having an attachment compatibility.

A developing device is mounted in an image forming apparatus of an electrophotographic system. The developing device stores, in its inside, developer that includes toner. The image forming apparatus includes a container attachment portion to which a toner container is attached. When the toner container is attached to the container attachment portion, the toner can be supplied from the toner container to the developing device. The developing device develops an electrostatic latent image formed on a photoconductor drum, by the toner contained in the developer. A toner image developed on the photoconductor drum is transferred to a print sheet. In addition, in a color image forming apparatus, a plurality of colors of toner images are transferred from a plurality of photoconductor drums to a transfer belt, and then a toner image is transferred from the transfer belt to a print sheet. The toner image transferred to the print sheet is fixed to the print sheet by a fixing device.

After the transfer, toner that was not transferred to the print sheet may remain on an image carrying member such as the photoconductor drum or the transfer belt. With regard to this problem, there is known a waste toner collecting device configured to remove the toner remaining on the image carrying member and collect the toner as waste toner. The waste toner collecting device of this type includes a waste toner container configured to store the removed waste toner. Conventionally, there is known an image forming apparatus that can use, as a waste toner container, a used-up toner container that had been used to supply toner to the developing device.

In addition, there is known an image forming apparatus in which a toner container for supplying toner, attached to the image forming apparatus, is provided with one or more compatible keys at certain positions that correspond to a type of the toner container. The compatible keys are a member for realizing what is called an incompatibility structure in which only a toner container of a type corresponding to a specific attachment portion is allowed to be attached to the specific attachment portion.

SUMMARY

An image forming apparatus according to an aspect of the present disclosure includes: a toner supplying portion including a first attachment portion that supports, in an attachable and detachable manner, a toner container at a predetermined first attachment position; and a waste toner collecting portion including a second attachment portion that supports, in an attachable and detachable manner, the toner container at a predetermined second attachment position. The toner container includes: a positioning member configured to, by being engaged with the first attachment portion that corresponds to a type of the toner container, position the toner container to the first attachment position of the first attachment portion; and a compatible key provided at a position corresponding to the type of the toner container and configured to allow the toner container to be selectively attached to the first attachment portion. The first attachment portion includes a first engaging portion configured to position the toner container to the first attachment position by being engaged with the positioning member of the toner container. The second attachment portion includes a second engaging portion configured to position the toner container to the second attachment position by being engaged with the positioning member of the toner container. The first engaging portion and the positioning member are formed in a shape that allows the toner container of the type corresponding to the first attachment portion to be selectively attached to the first attachment portion. The second engaging portion is formed in a shape that allows the positioning member to be engaged with a toner container of any one of a plurality of types.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an image forming apparatus 10 of the present disclosure with reference to the accompanying drawings. In the following description, an up-down direction D1, a front-rear direction D2, and a left-right direction D3 that are defined based on an installation state of the image forming apparatus 10 may be used.

[Image Forming Apparatus]

The image forming apparatus 10 has at least a print function and is, for example, a color printer. The image forming apparatus 10 prints an image on a print sheet that is a sheet member, by using developer containing toner. It is noted that a specific example of the image forming apparatus 10 is, for example, a printer, a copier, a facsimile, or a multifunction peripheral having functions of these apparatuses. In addition, although the image forming apparatus 10 is configured to form a color image, the image forming apparatus may be configured to form a monochrome image as far as it uses a toner container 41.

Figure 1:
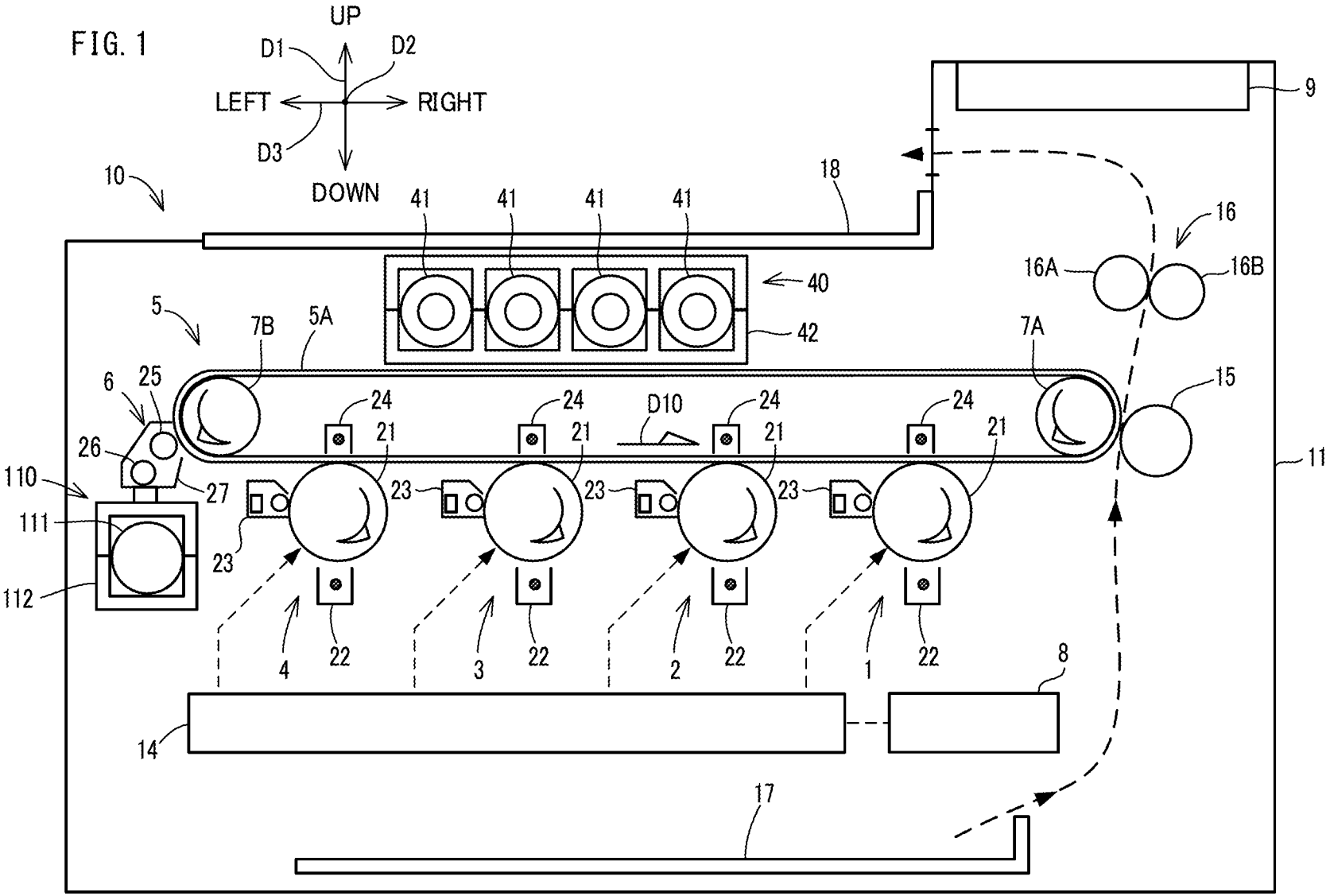
FIG. 1 is a diagram showing a configuration of an image forming apparatus according to an embodiment of the present disclosure.

As shown in FIG. 1, the image forming apparatus 10 is what is called a tandem-system color image forming apparatus. The image forming apparatus 10 includes a plurality of image forming portions 1 to 4, an intermediate transfer unit 5, an exposure device 14, a secondary transfer device 15, a fixing device 16, a toner supply device 40 (an example of a toner supplying portion of the present disclosure), a belt cleaning device 6, a waste toner collecting device 110 (an example of a waste toner collecting portion of the present disclosure), an operation/display portion 9 including a touch panel, a liquid crystal display portion and the like, a control portion 8, a sheet feed tray 17, and a sheet discharge tray 18. These components are attached to a housing 11 that constitutes an external frame (not shown), an internal frame and the like of the image forming apparatus 10.

The image forming portions 1 to 4 form, by what is called an electrophotographic system, toner images of different colors respectively on a plurality of photoconductor drums 21 that are arranged in alignment. The toner images are transferred to an intermediate transfer belt 5A while it is running (moving) such that the toner images are overlaid with each other thereon. In the example shown in FIG. 1, an image forming portion 1 for black, an image forming portion 2 for yellow, an image forming portion 3 for cyan, and an image forming portion 4 for magenta are arranged in alignment in the stated order from the downstream side in the moving direction (a direction indicated by the arrow D10) of the intermediate transfer belt 5A.

The image forming portions 1 to 4 are provided below the intermediate transfer belt 5A. Each of the image forming portions 1 to 4 includes a photoconductor drum 21 carrying a toner image thereon, a charging device 22, a developing device 23, and a primary transfer device 24. The surface of the photoconductor drum 21 is electrically charged by the charging device 22, and the charged surface of the photoconductor drum 21 is exposure-scanned by the exposure device 14. This allows an electrostatic latent image to be formed on the surface of the photoconductor drum 21. The developing device 23 develops the electrostatic latent image with the toner. Subsequently, the toner image on the photoconductor drum 21 is transferred to the intermediate transfer belt 5A by the primary transfer device 24.

The intermediate transfer unit 5 includes the intermediate transfer belt 5A, a driving roller 7A, and a driven roller 7B. The intermediate transfer belt 5A carries a toner image that is formed from toner images of a plurality of (in the present embodiment, four) colors. The intermediate transfer belt 5A is supported and rotationally driven by the driving roller 7A and the driven roller 7B so as to move while its surface is in contact with surfaces of the photoconductor drums 21. When the intermediate transfer belt 5A is rotationally driven, a lower belt portion thereof passes between the photoconductor drums 21 and the primary transfer devices 24. At this time, the toner images of the different colors carried on the plurality of photoconductor drum 21 are transferred in sequence to the intermediate transfer belt 5A in such a way as to be overlaid with each other.

The toner supply device 40 is provided above the intermediate transfer unit 5. The toner supply device 40 includes a container attachment portion 42 to which four toner containers 41 for colors of black, yellow, cyan, and magenta are attached. The container attachment portion 42 is configured such that the toner containers 41 are attached thereto in a detachable manner. The configuration of the toner supply device 40 is described below.

The secondary transfer device 15 transfers the toner image from the intermediate transfer belt 5A to a print sheet conveyed from the sheet feed tray 17. The print sheet on which the toner image has been transferred is conveyed by a conveyance portion (not shown) to the fixing device 16. The fixing device 16 includes a heating roller 16A and a pressure roller 16B. The fixing device 16 conveys the print sheet on which the toner image has been transferred, while applying heat and pressure thereto. This allows the toner image to be fused and fixed to the print sheet. The print sheet with the toner image fixed thereto is further conveyed to the downstream side, and discharged to and held by the sheet discharge tray 18 that is disposed above the intermediate transfer unit 5.

The belt cleaning device 6 collects waste toner, namely toner that has remained on the surface of the intermediate transfer belt 5A, and conveys the collected waste toner to the waste toner collecting device 110. The belt cleaning device 6 is disposed in front of the intermediate transfer unit 5. The belt cleaning device 6 includes a cleaning roller 25, a screw member 26, and a toner box 27, wherein the cleaning roller 25 is a cleaning member. The cleaning roller 25 is disposed to face the driven roller 7B, and its surface is in contact with the intermediate transfer belt 5A. The length of the cleaning roller 25 in the front-rear direction D2 is approximately the same as the intermediate transfer belt 5A. The cleaning roller 25 is rotatably supported in the toner box 27. The cleaning roller 25 rotates when a rotational driving force is input to the rotation shaft of the cleaning roller 25.

The cleaning roller 25 is rotated while in contact with the intermediate transfer belt 5A, thereby removing toner that has remained on the surface of the intermediate transfer belt 5A after the toner image was transferred therefrom by the secondary transfer device 15. Hereinafter, the toner removed by the cleaning roller 25 is referred to as "waste toner". The waste toner is taken and collected in the toner box 27 by the rotational force of the cleaning roller 25 or by the action of gravity. The waste toner collected in the toner box 27 is conveyed by the screw member 26. A discharge port (not shown) is formed at a rear end portion of a bottom surface of the toner box 27. When the screw member 26 is rotated, the waste toner is conveyed in the toner box 27 toward the discharge port.

The waste toner collecting device 110 is provided in a lower part of the toner box 27. The waste toner collecting device 110 is configured such that a waste toner container 111 is attached thereto in a detachable manner. When the waste toner is discharged from the discharge port of the belt cleaning device 6, the waste toner is stored in the waste toner container 111 attached to the waste toner collecting device 110. That is, the toner that has remained on the surface of the intermediate transfer belt 5A is removed by the belt cleaning device 6 and then, as the waste toner, is stored in the waste toner container 111. In the present embodiment, an empty toner container 41 that had been used in the toner supply device 40 is used as the waste toner container 111. The waste toner collecting device 110 is described below.

[Toner Supply Device]

In the following, the toner supply device 40 is described with reference to FIG. 2 to FIG. 7.

Figure 2:
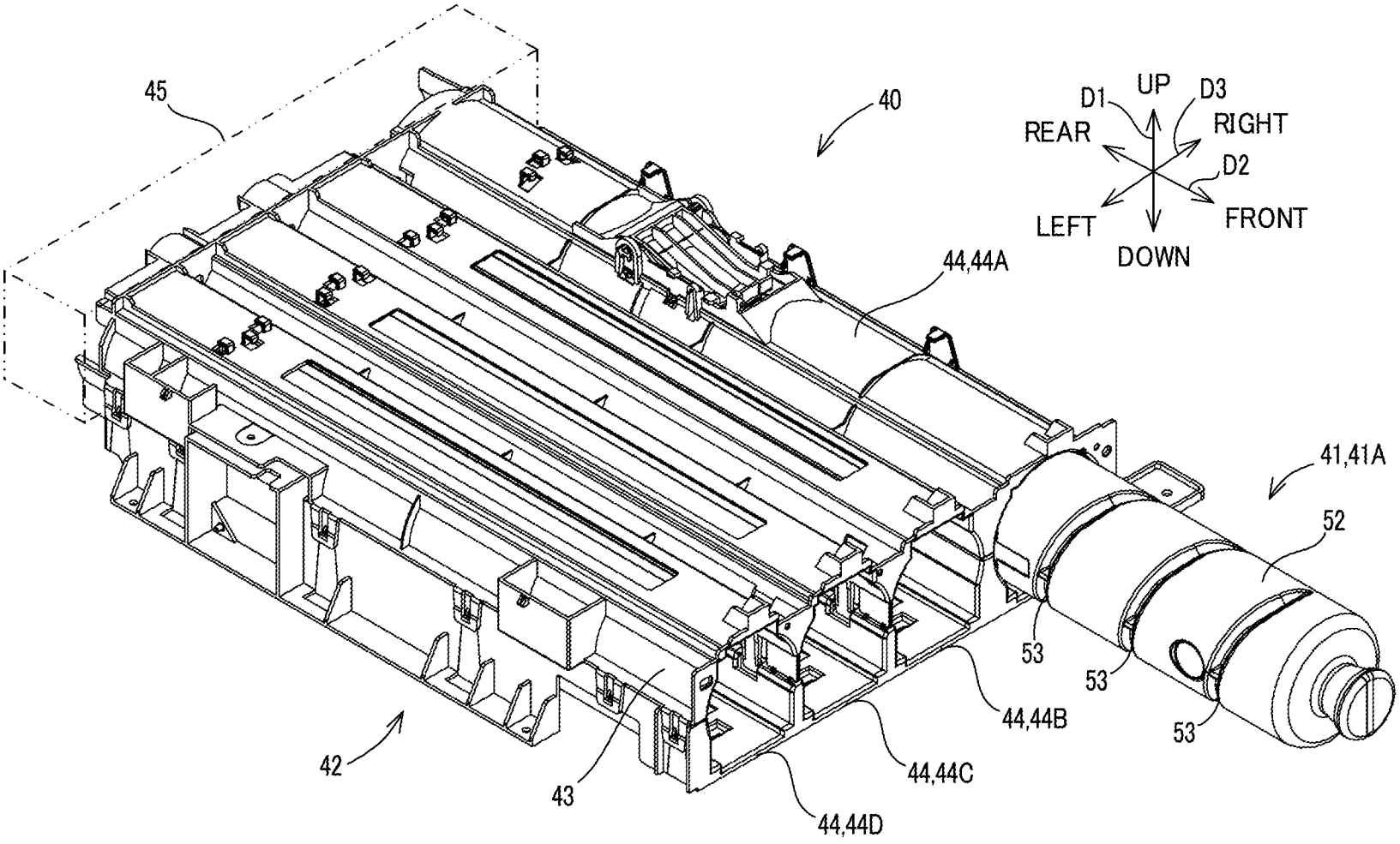
FIG. 2 is a perspective diagram of a toner supply device included in the image forming apparatus.

As shown in FIG. 2, the toner supply device 40 includes the toner containers 41 and the container attachment portion 42 to which the toner containers 41 are attached. It is noted that FIG. 2 shows a state where only the toner container 41 for black is attached to the container attachment portion 42. In addition, in the drawings, the up-down direction D1, the front-rear direction D2, and the left-right direction D3 are defined based on an attachment attitude in which the toner supply device 40 is attached to the housing 11. In addition, in the drawings, an insertion direction of the toner container 41 is indicated by a sign D21, and a removal direction is indicated by a sign D22.

The toner containers 41 store toner that is to be supplied to the developing device 23. In the present embodiment, four toner containers 41 corresponding to the colors of black, yellow, cyan and magenta are provided in the toner supply device 40. It is noted that the toner container 41 for black has a larger external diameter than the toner containers 41 for the other colors, but except for this, all the toner containers 41 have the same configuration. In the following description, the toner container 41 refers to the toner container 41 for black unless otherwise mentioned.

The toner container 41 is configured to be attachable to the container attachment portion 42 and the waste toner collecting device 110 described below. The toner container 41 is formed to match the specification of the image forming apparatus 10. The specification defines the material of the toner, the toner storage amount, the color tone of the toner and the like, to be different according to the use environment or the use country (destination). In the present embodiment, the image forming apparatus 10 is configured such that only the toner containers 41 that match the specification of the image forming apparatus 10 can be attached to the container attachment portion 42, and toner containers that do not match the specification of the image forming apparatus 10 (hereinafter, such toner containers may be referred to as "mismatch containers") can not be attached to the container attachment portion 42.

Figure 3:
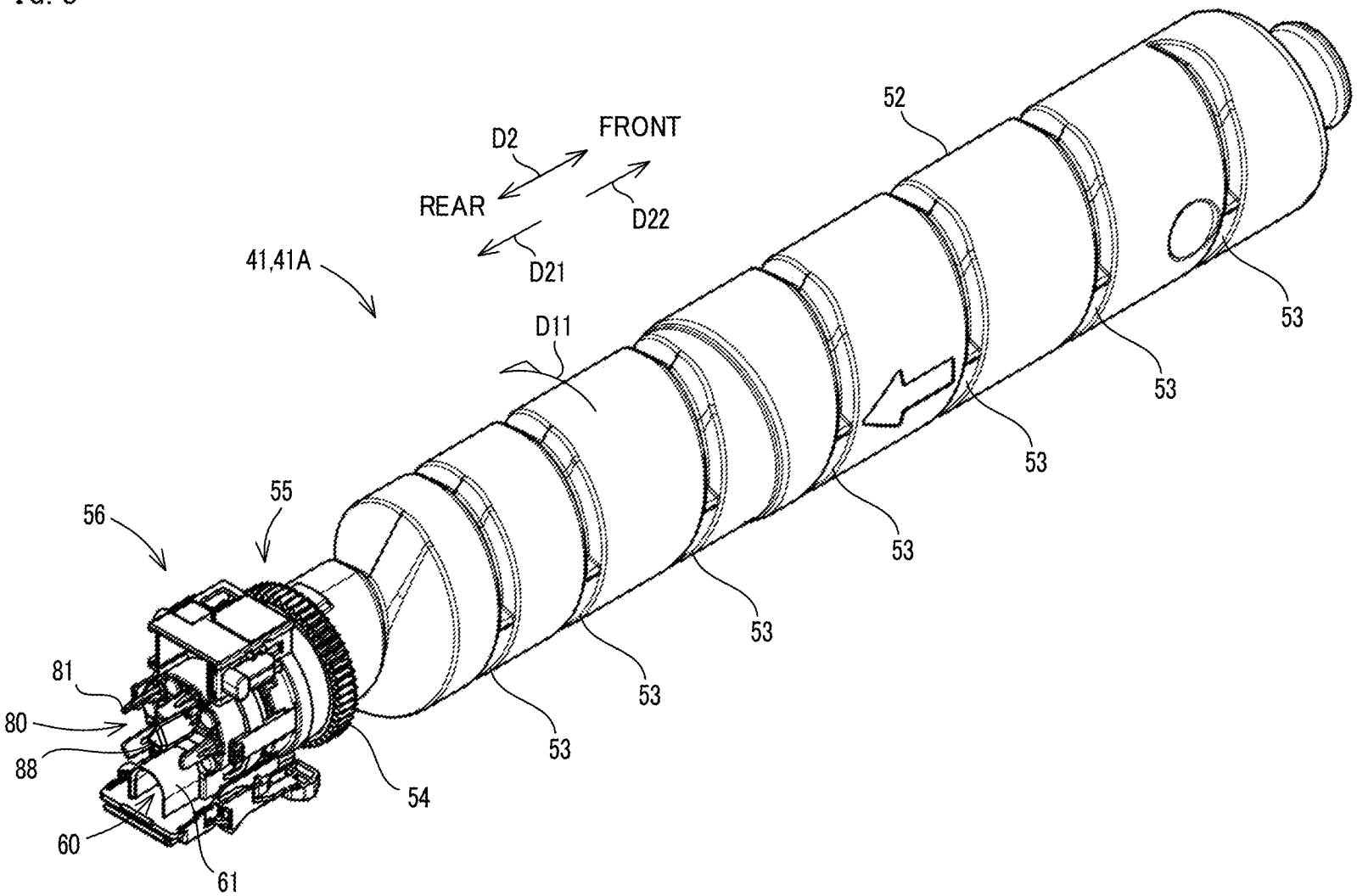
FIG. 3 is a perspective diagram of a toner container that is attachable to and detachable from the toner supply device.

As shown in FIG. 3, the toner container 41 is elongated in the front-rear direction D2. The toner container 41 includes a container main body 52, a worm wheel 55, and a coupling member 56.

The container main body 52 is formed approximately in a cylindrical shape. The toner is stored in the inside of the container main body 52. The container main body 52 includes, at an end portion (an example of a tip portion) on one side (rear side) thereof, an outflow port 51 (see FIG. 5) from which the toner flows out. The outflow port 51 is formed at an end portion of the toner container 41 in the insertion direction D21 (on the rear side) in which the toner container 41 is inserted in the toner replenishment device 40. The toner flows out from the container main body 52 through the outflow port 51. It is noted that an end portion of the container main body 52 on the other side (front side) is closed. As a result, the container main body 52 is formed in a cylindrical bottle shape.

The container main body 52 is a resin molded product made from, for example, a synthetic resin such as polyethylene terephthalate (PET resin) by the blow molding method or the injection molding method. The end portion of the container main body 52 on the rear side (on the insertion direction D21 side) is a neck portion 57 of a cylindrical shape with a small diameter, projecting in the insertion direction D21. The outflow port 51 of a circular shape is provided at an end portion of the neck portion 57 of the container main body 52.

The container main body 52 includes a conveyance rib 53 as a toner conveyance portion that conveys the toner inside the container main body 52 toward the outflow port 51. The conveyance rib 53 is formed on the inner surface of the container main body 52 to be spiral and have a mountain shape. The conveyance rib 53 projects from the inner surface of the container main body 52 toward the center of the container main body 52. The conveyance rib 53 has a role of conveying the toner inside the container main body 52 toward the outflow port 51 (see FIG. 5).

Figure 4:
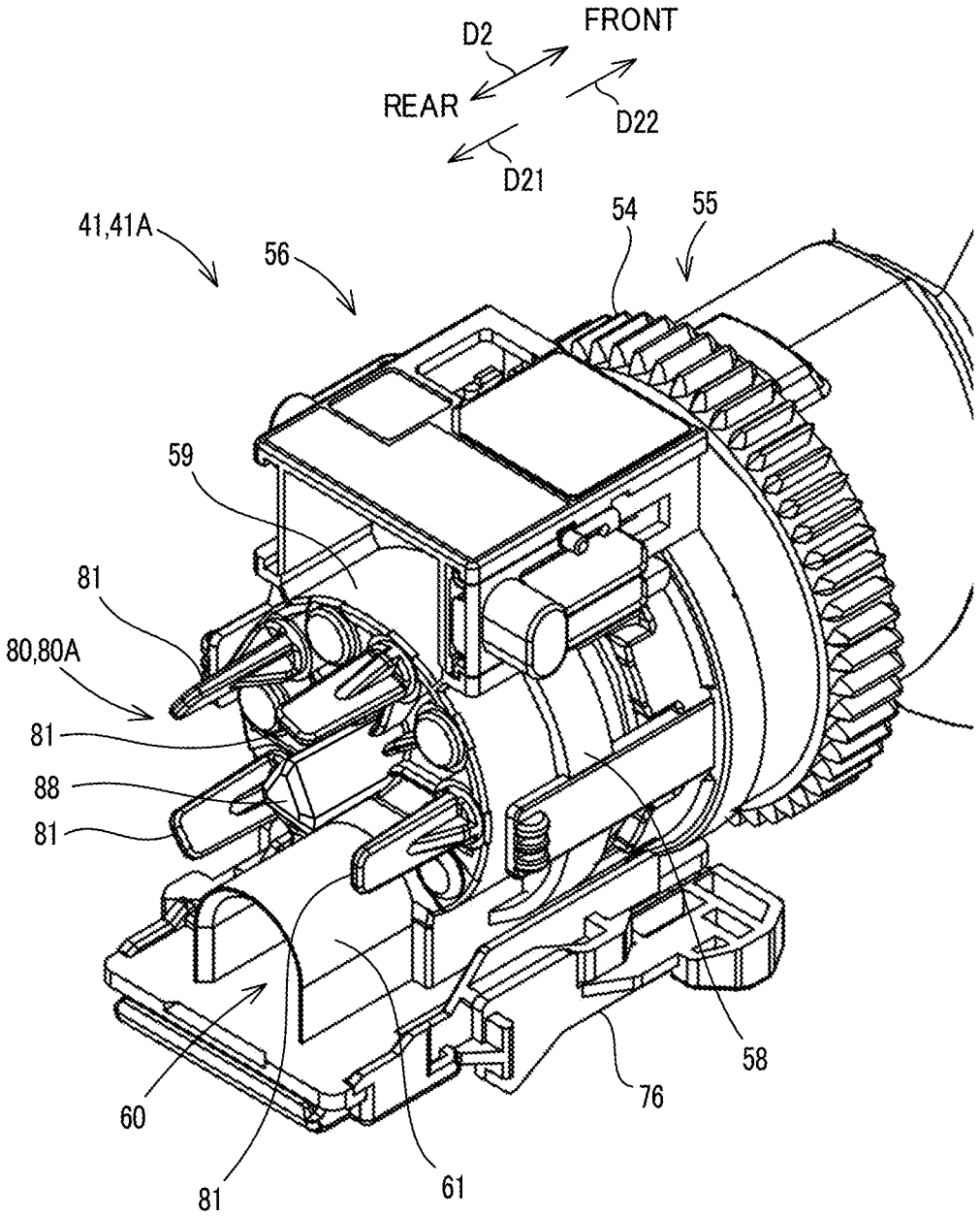
FIG. 4 is an enlarged perspective diagram of a coupling member of the toner container.

As shown in FIG. 4, the worm wheel 55 as a drive transmission portion is attached to the outflow port 51 side of the container main body 52. The worm wheel 55 is fixed to the container main body 52. The worm wheel 55 applies, to the container main body 52, a rotational driving force that is required for the conveyance rib 53 to convey the toner. The worm wheel 55 is an annular member, with a gear 54 formed on its peripheral surface. The worm wheel 55 is fitted to the neck portion 57 and is fixed to the outer peripheral surface of the neck portion 57. Upon receiving a rotational driving force from a drive source such as a motor, the worm wheel 55 transmits a rotational driving force for rotation in a direction of the arrow D11, to the toner container 41.

In the container main body 52, the coupling member 56 is provided more on the insertion direction D21 side (rear side) than the worm wheel 55. The coupling member 56 is attached to an end portion of the container main body 52 on the insertion direction D21 side to cover the outflow port 51. The coupling member 56 is a resin molded product made from, for example, a thermoplastic synthetic resin by the injection molding method.

The coupling member 56 includes a cylindrical storage frame 58 in which the neck portion 57 (see FIG. 5) is inserted in a state where the coupling member 56 is attached to the container main body 52. When the neck portion 57 is inserted in the storage frame 58, the outflow port 51 is disposed inside the storage frame 58. This allows the outflow port 51 to be covered with the storage frame 58. The storage frame 58 supports the neck portion 57 such that the neck portion 57 can pivot in the circumferential direction. As a result, in a state where the neck portion 57 is inserted in the storage frame 58, the container main body 52 can pivot in the circumferential direction.

When the toner container 41 is attached to the container attachment portion 42 (see FIG. 2), a coupling portion 80 (see FIG. 3), provided in the coupling member 56 and described below, is engaged with a coupled portion 90 (see FIG. 7), provided in the container attachment portion 42 and described below, and the toner container 41 is attached to the container attachment portion 42. The engagement of the coupling portion 80 with the coupled portion 90 restricts the coupling member 56 from pivoting in the circumferential direction of the toner container 41. In the state where the toner container 41 is attached to the container attachment portion 42, the coupling member 56 cannot rotate in the circumferential direction, but the container main body 52 is supported in the container attachment portion 42 in such a way as to be pivotable in the circumferential direction.

When the rotational driving force is transmitted to the worm wheel 55 in the state where the toner container 41 is attached to the container attachment portion 42, the container main body 52 is rotated by the rotational driving force in a rotation direction indicated by the arrow D11 (see FIG. 3). That is, in a state where the toner can be supplied from the toner container 41 to the developing device 23, the toner container 41 rotates around its longitudinal direction. When the container main body 52 of the toner container 41 rotates in this way, the toner is pressed and conveyed by the conveyance rib 53 toward the outflow port 51 (rearward).

Figure 5:
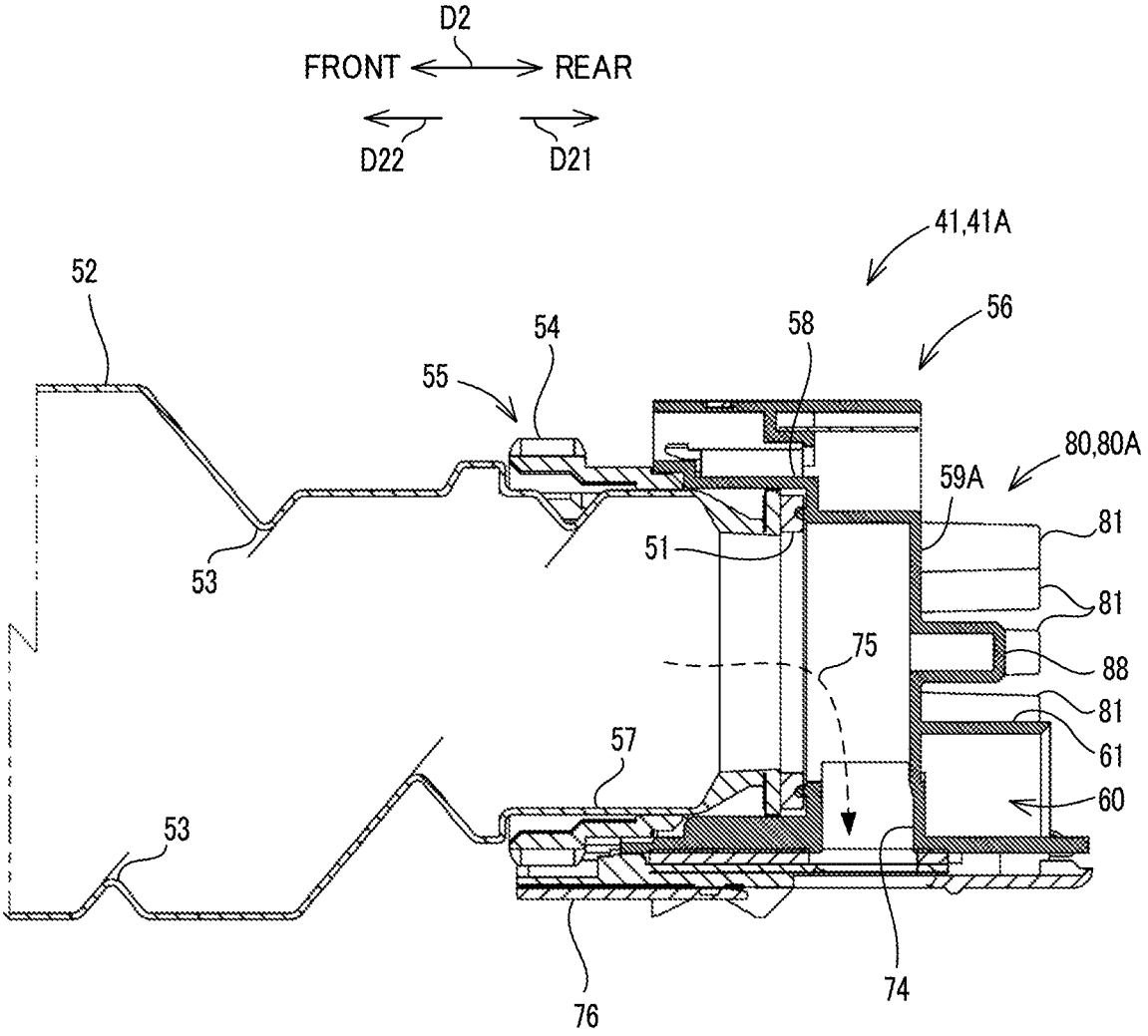
FIG. 5 is a cross-sectional diagram of a tip portion of the toner container in an insertion direction.

The coupling member 56 includes a toner discharge port 74 (see FIG. 5). The toner discharge port 74 is used to discharge the toner from the container main body 52 to outside, and is provided at an outer peripheral wall of the coupling member 56. Referring to FIG. 5, the toner discharge port 74 is provided at a lower portion of the coupling member 56. Specifically, the toner discharge port 74 is a rectangular through hole that passes through the outer peripheral wall of the coupling member 56. As shown in FIG. 5, a toner passage 75 is formed inside the coupling member 56 between the outflow port 51 and the toner discharge port 74. When the toner container 41 is attached to the container attachment portion 42 (see FIG. 2) with the toner discharge port 74 facing downward, the toner flows out from the outflow port 51 of the container main body 52, passes the toner passage 75 to move downward, and reaches the toner discharge port 74. At this time, in a case where the toner discharge port 74 is open, the toner is discharged downward from the toner discharge port 74 to outside. This allows the toner to be replenished to the developing device 23. On the other hand, in a case where the toner discharge port 74 is closed by a shutter member 76, the toner is not discharged, and the toner passage 75 is filled with the toner.

As shown in FIG. 5, the coupling member 56 includes a slide-type shutter member 76 as an opening/closing member. The shutter member 76 is a plate-like member, and is supported by the coupling member 56 in such a way as to be slidable in the longitudinal direction of the container main body 52 (the front-rear direction D2). The shutter member 76 opens or closes the toner discharge port 74 depending on the position of the toner container 41 with respect to the container attachment portion 42. FIG. 5 shows a state where the shutter member 76 has moved to the front side and opened the toner discharge port 74. When the toner container 41 is attached to the container attachment portion 42, the shutter member 76 is moved with the attachment operation to an opening position to open the toner discharge port 74, and the toner discharge port 74 is opened. In addition, when the toner container 41 is removed from the container attachment portion 42, the shutter member 76 moves rearward by the removal operation from the opening position to a position (closing position) to close the toner discharge port 74, and the toner discharge port 74 is closed. It is noted that the container attachment portion 42 includes a biasing member (not shown) such as a coil spring, and the movement of the shutter member 76 from the opening position to the closing position is realized as the biasing member applies a biasing force to the shutter member 76, thereby causing the shutter member 76 to move relatively rearward in response to the removal operation of the toner container 41.

As shown in FIG. 4, the coupling member 56 includes a base portion 59 more on the insertion direction D21 side than the storage frame 58, wherein the base portion 59 is cylindrical and hollow inside. The base portion 59 is integrally formed with the coupling portion 80 that is described later. On an end surface 59A (see FIG. 5) of the base portion 59 on the insertion direction D21 side, an arch-shaped guide wall 61 is provided so as to project from the end surface 59A. The guide wall 61 is provided at the center of a lower end portion of the end surface 59A. A hole 60 surrounded by the guide wall 61 is a portion in which a coil spring (not shown) of the container attachment portion 42 is inserted when the toner container 41 is attached to one of storage portions 44 (an example of a first attachment portion of the present disclosure, see FIG. 2) that are described below.

In addition, a projection 88 (an example of a positioning member of the present disclosure) is integrally formed with the end surface 59A at the center thereof. The projection 88 is provided in such a way as to position the toner container 41 to an attachment position (a first attachment position) defined in the container attachment portion 42 when the toner container 41 is attached to the storage portion 44. It is noted that the attachment position is a position where the toner discharged from the toner discharge port 74 is supplied to the replenishment port of the developing device 23.

The projection 88 is a protruding member that protrudes from the end surface 59A in the insertion direction D21. The projection 88 is engaged with a hole 96 of a protruding boss 94 (see FIG. 7, an example of a first engaging portion of the present disclosure) provided on a coupling support portion 45 of the container attachment portion 42, when the toner container 41 is attached to the storage portion 44. Specifically, the projection 88 is inserted in the hole 96. This allows the projection 88 and the protruding boss 94 to be engaged with each other, and the toner container 41 is positioned to an attachment position defined in the storage portion 44. It is noted that, when the toner container 41 is attached to the storage portion 44, the coil spring is inserted, in the state of being contracted, in the hole 60. Thus, the toner container 41 is locked at the attachment position of the storage portion 44 by a locking mechanism (not shown) so that the toner container 41 is not released by the spring force of the coil spring.

In the present embodiment, the projections 88 of the toner containers 41 for the respective colors and the protruding bosses 94, that are described below, in which the projections 88 are inserted, are formed in a certain shape such that the toner containers 41 are selectively attached to the corresponding storage portions 44 of the image forming apparatus 10. Each projection 88 of the toner containers 41 of the respective colors is formed in a shape that is unique to the toner container 41 configured to be attached to the image forming apparatus 10. In addition, the hole 96 of the protruding boss 94, that is described below, in which the projection 88 is inserted, is formed in a shape unique to the image forming apparatus 10.

Figure 6:
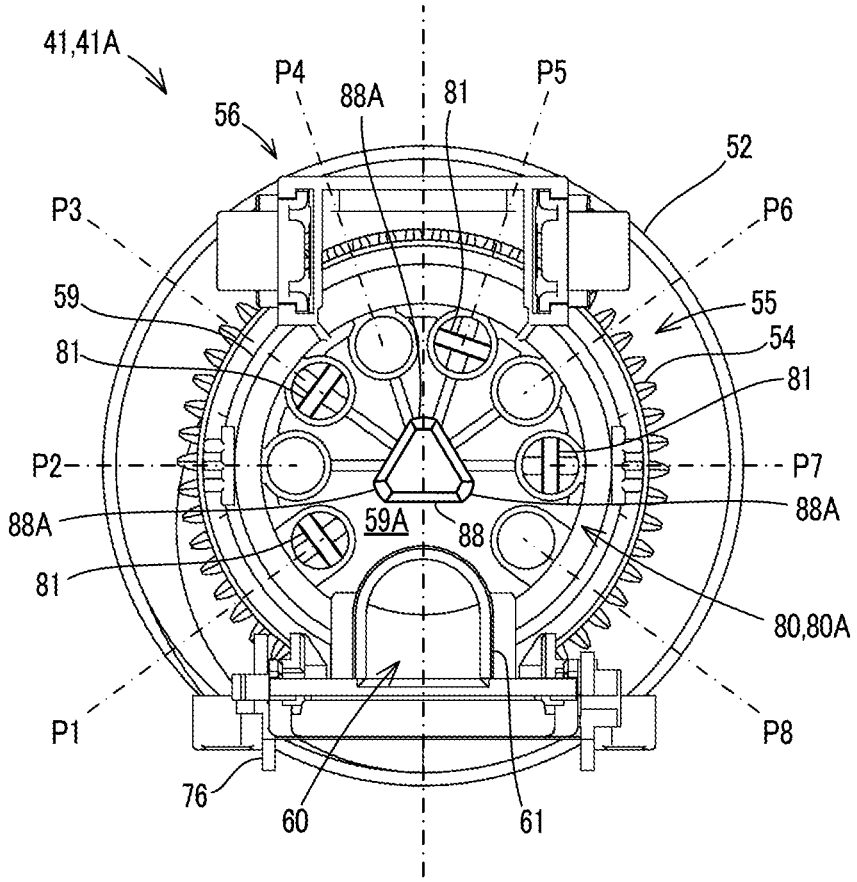
FIG. 6 is a front diagram of the coupling member of the toner container.

As shown in FIG. 6, the projection 88 is formed approximately in the shape of a triangular prism (non-cylindrical shape). Here, FIG. 6 is a front diagram of the coupling member 56 of a toner container 41A. Specifically, the projection 88 is a columnar member formed such that corner portions 88A (an example of a maximum radius portion of the present disclosure) of an equilateral triangular prism are formed in the shape of an arc of radius R1 having a center at the center line of the projection 88. In addition, the protruding boss 94 corresponding to the projection 88 includes a hole 96 having an approximately triangular cross section (see FIG. 7) so that the projection 88 can be inserted in the hole 96. As a result, if another type of toner container that can be attached to another type of image forming apparatus, is inserted in the image forming apparatus 10 of the present embodiment, the other type of toner container cannot be attached to any one of the storage portions 44 of the image forming apparatus 10 of the present embodiment since the shape of the projection of the other type of toner container does not correspond to the shape of the hole 96 of the protruding boss 94.

As shown in FIG. 2, the container attachment portion 42 includes a storage case 43 and the coupling support portion 45, wherein the storage case 43 includes four storage portions 44 (44A to 44D) as the first attachment portion, and the coupling support portion 45 is attached to the rear end surface of the storage case 43. It is noted that in FIG. 2, the coupling support portion 45 is represented by a two-dot chain line.

The storage portions 44 of the storage case 43 support the toner containers 41 of predetermined colors such that the toner containers 41 are attached thereto in a detachable manner. The rightmost storage portion 44A stores the toner container 41 for black. FIG. 2 shows a state where the toner container 41 for black is inserted in the storage portion 44. In the present embodiment, the container attachment portion 42 supports the toner containers 41 in the storage portions 44 in a state where the toner containers 41 are laid transversely, namely, in a horizontal state.

The coupling support portion 45 is coupled with the coupling portions 80 of the toner containers 41 inserted in the storage portions 44 in such a way as to fix the rear end portions of the toner containers 41, and support the toner containers 41 at the attachment positions defined in the storage portions 44. The coupling support portion 45 is mounted independent of the storage case 43, and is attached to the storage case 43 or an internal frame of the housing 11. The coupling support portion 45 is provided with four coupled portions 90 in correspondence with the four storage portions 44. It is noted that in the container attachment portion 42, the coupling support portion 45 and the storage case 43 may be integrally formed with each other.

The image forming apparatus 10 of the present embodiment is configured such that the mismatch containers containing mismatch toner cannot be attached to the image forming apparatus 10. Here, the mismatch toner refers to toner that does not match the specification of the image forming apparatus 10. In a case where the specifications for the material of the toner, the toner storage amount and the like are different for each environment or each country (destination) in which the image forming apparatus is used, if a toner that does not match the specification is used, degradation of image quality may occur, or a failure may occur to the image forming portion. In addition, there may be a case where toners of a same color differ from each other in color tone according to the use country. In that case, images of a color tone desired by the user may not be realized. In view of this, the image forming apparatus 10 of the present embodiment is configured such that only the toner containers 41 that match the specification of the image forming apparatus 10 can be attached to the storage portions 44 that respectively correspond to the toner containers 41. In other words, the storage portions 44 are formed such that the toner containers 41 having the attachment compatibility are selectively attached to the storage portions 44. For this purpose, the coupling portion 80 is provided at the tip portion of the toner container 41 in the insertion direction D21, and the coupled portion 90 is provided in the coupling support portion 45.

When the toner container 41 is inserted in the storage portion 44, and the coupling portion 80 of the toner container 41 is engaged with the coupled portion 90, the attachment of the toner container 41 is permitted. On the other hand, when the coupling portion 80 of the toner container 41 is not engaged with the coupled portion 90, the attachment of the toner container 41 is prohibited. Such a configuration for realizing the attachment compatibility between the coupled portion 90 and the coupling portion 80 is typically referred to as an incompatibility structure.

The following describes the configuration of the coupling portion 80.

As shown in FIG. 4, the coupling portion 80 is provided on the end surface 59A (see FIG. 5) of the base portion 59 of the coupling member 56. Here, FIG. 4 shows the tip portion of the toner container 41 for black that is inserted in the storage portion 44 corresponding to black. Hereinafter, for explanation's sake, the toner container 41 for black is referred to as a toner container 41A, and the coupling portion 80 provided in the toner container 41A is referred to as a coupling portion 80A.

The coupling portion 80A is provided on the tip portion of the toner container 41A in the insertion direction D21. The coupling portion 80 is provided not only in the toner container 41A for black, but also in each of the toner containers 41 for yellow, cyan, and magenta. The coupling portions 80 for the respective colors are formed in the same shape, and are formed in a shape that is unique to the type of the image forming apparatus 10. In the following, as the representative of the coupling portions 80 for different colors, the coupling portion 80A for black is described with reference to FIG. 4.

As shown in FIG. 4, the coupling portion 80A is integrally provided with the coupling member 56 of the toner container 41A. As described above, the coupling member 56 includes the base portion 59 that is cylindrical and hollow inside. The coupling portion 80A is provided on the end surface 59A of the base portion 59. The coupling portion 80A is integrally formed with the coupling member 56 when the coupling member 56 is molded.

The coupling portion 80A includes four compatible keys 81 (an example of a compatible key of the present disclosure). The four compatible keys 81 are positioned so as to be engaged with the coupled portion 90A for black. The compatible keys 81 are protruding members that protrude from the end surface 59A in the insertion direction D21 (namely, toward the coupled portion 90A), and each of the compatible keys 81 has a flat tip. The compatible keys 81 are made of insulator that does not allow electricity to pass through it. The four compatible keys 81 are formed at positions where they do not interfere with interference keys 99 (see FIG. 7) that are provided on the coupled portion 90A, in the attachment state where the toner container 41A is attached to the storage portion 44A of the container attachment portion 42.

In the present embodiment, as shown in FIG. 6, positions P1 to P8 are defined to be on the circumference of a circle arranged around the projection 88, as the positions at which the compatible keys 81 can be disposed. The same positions are defined as the positions P1 to P8 in each of the coupling portions 80 of the toner containers 41, and are defined to be on the circumference at an equal angle interval based on the projection 88. That is, the positions P1 to P8 are arranged along the circumference in the coupling portion 80A. In the example shown in FIG. 6, on the end surface 59A, the position P1 is defined to be adjacent to the guide wall 61 in the CW (clockwise) direction, and the positions P2 to P8 are defined to be at an equal angle interval from the position P1 in the CW direction. As shown in FIG. 6, the positions P1 to P8 are arranged symmetrically with respect to a vertical line passing through the center of the projection 88. In the toner container 41A, the four compatible keys 81 are provided at positions P1, P3, P5 and P7 among the positions P1 to P8. In other words, the four compatible keys 81 are arranged along the circumference of the circle on the end surface 59A of the coupling portion 80A.

In the following, configurations of the coupling support portion 45 and the coupled portions 90 (90A to 90D) are described.

Figure 7:
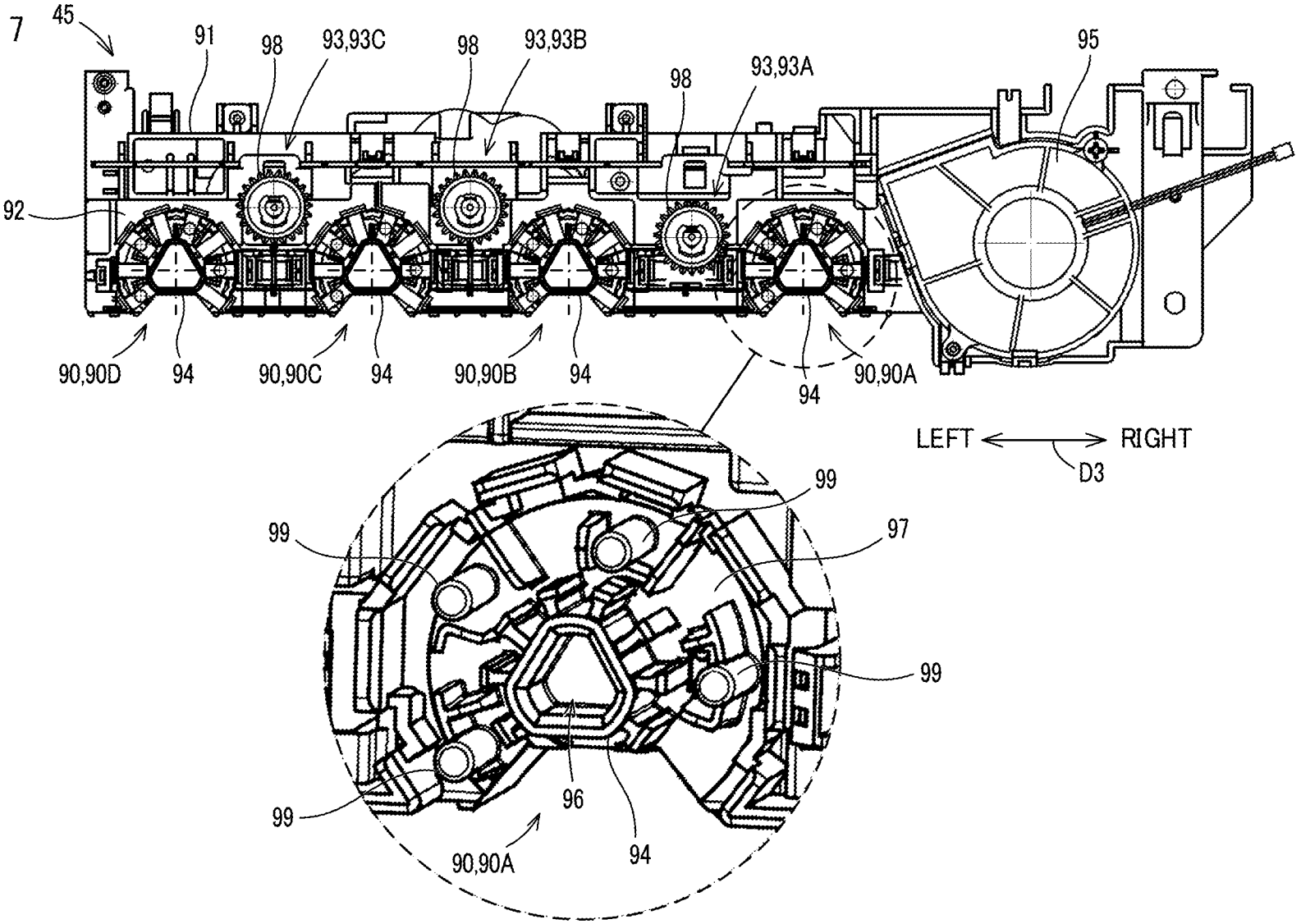
FIG. 7 is a diagram showing a configuration of a coupling support portion included in the toner supply device.

As shown in FIG. 7, the coupling support portion 45 includes a frame 91 that can be attached to the rear end surface of the storage case 43. Here, FIG. 7 shows the configuration of the coupling support portion 45 provided in the toner supply device 40, and details of the coupled portion 90A. In FIG. 7, a partially enlarged diagram of the coupled portion 90A is shown as a perspective diagram.

The frame 91 is elongated in the left-right direction D3. On an attachment surface 92 of the frame 91 in its front side, four coupled portions 90 (90A to 90D), three drive transmission portions 93 (93A to 93C), and a blower fan 95 are attached.

The four coupled portions 90 are aligned straight in the longitudinal direction of the frame 91. The rightmost coupled portion 90A is coupled with the toner container 41 for black. The coupled portions 90B, 90C, and 90D disposed on the left side of the coupled portion 90A are respectively coupled with the toner containers 41 for yellow, cyan, and magenta.

Each of the drive transmission portions 93 receives a rotational driving force from a drive source such as a motor in the housing 11, and transmits the rotational driving force to the gear 54 of the toner container 41. Each of the drive transmission portions 93 includes a gear 98 that is rotationably supported by a support portion (not shown) that is cylindrical and projects vertically from the attachment surface 92.

The drive transmission portion 93A is provided in the vicinity of the coupled portion 90A, and in a state where the toner container 41 for black is attached to the storage portion 44A, the gear 98 of the drive transmission portion 93A is coupled with the gear 54. The drive transmission portion 93B is provided in the vicinity of the coupled portion 90B, and in a state where a toner container 41 is attached to the storage portion 44B, the gear 98 of the drive transmission portion 93B is coupled with the gear 54. In addition, the drive transmission portion 93C is provided between the coupled portion 90C and the coupled portion 90D, and in a state where the toner containers 41 are respectively attached to the storage portion 44C and the storage portion 44D, the gears 98 are coupled with the gears 54 of the toner containers 41, respectively.

The four coupled portions 90 (90A to 90D) have the same shape and configuration. As a result, in the following, the coupled portion 90A for black is described as the representative of the coupled portions 90 for different colors.

As shown in the enlarged diagram provided in FIG. 7, the coupled portion 90A includes four interference keys 99 and the protruding boss 94.

The protruding boss 94 is provided at the center of the coupled portion 90A. The protruding boss 94 is provided such that, when the toner container 41 is attached to the storage portion 44, the protruding boss 94 is engaged with the projection 88, and the toner container 41 is positioned to the attachment position (first attachment position) defined in the container attachment portion 42. The protruding boss 94 is a cylindrical member protruding from a base plate 97 of the coupled portion 90A toward the toner container 41A (frontward). A hole 96 is formed at the center of the front end surface of the protruding boss 94. The hole 96 is a portion into which the projection 88 for positioning is inserted, wherein the projection 88 is provided on the end surface 59A of the coupling member 56.

In the present embodiment, the protruding bosses 94 of the coupled portions 90 for the respective colors are formed in a shape that is unique to the image forming apparatus 10. Specifically, the hole 96 is formed to have an approximately triangular cross section such that the projection 88 of the above-described triangular prism shape can be inserted therein. More specifically, in the cross-sectional shape of the hole 96, the corner portions of an equilateral triangle are formed in the shape of an arc of a radius R2 having a center at the center line of the protruding boss 94. As a result, if another type of toner container (a mismatch container that does not match the image forming apparatus 10) that can be attached to another type of image forming apparatus, is inserted in the image forming apparatus 10 of the present embodiment, the other type of toner container cannot be attached to any one of the storage portions 44 of the image forming apparatus 10 of the present embodiment since the shape of the projection of the other type of toner container does not correspond to the shape of the hole 96 of the protruding boss 94. That is, such another type of toner container does not have an attachment compatibility with respect to the storage portion 44A. Here, the radius R2 is slightly larger than the radius R1 so as to allow for insertion of the projection 88.

For example, in a case where the projection of the other type of toner container has approximately the same size as the projection 88 of the present embodiment, and is formed in the shape of a polygonal prism, a cylinder, an elliptic cylinder or the like other than the triangular prism, the projection of the other type of toner container cannot be inserted in the hole 96, and the other type of toner container (a mismatch container) cannot be attached to any one of the storage portions 44. It is noted that the maximum radius of the projection of the other type of toner container, namely a length from the center to the outer peripheral surface, is assumed to be the radius R1.

The four interference keys 99 are provided at predetermined positions in the coupled portion 90A. Each of the interference keys 99 is a bar-like protruding member projecting from the attachment surface 92 toward the toner container 41A (frontward).

The positions of the four interference keys 99 are defined to be on the circumference of a circle centered at the protruding boss 94. Specifically, the four interference keys 99 are provided at positions where they do not interfere with the compatible keys 81 when the toner container 41 is attached to the storage portion 44. In other words, the four interference keys 99 are disposed at positions on the attachment surface 92 of the coupled portion 90A where, if another type of toner container is inserted, they abut on a projection provided in the other type of toner container. With this configuration, when the toner container 41A having attachment compatibility with the coupled portion 90A is inserted in the storage portion 44A, the compatible keys 81 are disposed at the positions at which no interference key 99 is provided. This makes it possible to attach the toner container 41A to the storage portion 44A, without allowing the interference keys 99 to hinder the attachment of the toner container 41A.

On the other hand, if a toner container 41 that does not correspond to the coupled portion 90A and does not have the attachment compatibility, is inserted in the storage portion 44A, the compatible keys 81 abut on the interference keys 99, and the interference keys 99 hinder the attachment of the toner container 41A. Accordingly, if another type of toner container that has a compatible key 81 at any one of the positions P1, P3, P5 and P7, is inserted in the storage portion 44A, the tip of the compatible key 81 abuts on the tip of any one of the interference keys 99. This prevents the other type of toner container from being inserted further and being attached to the storage portion 44A. That is, such another type of toner container does not have attachment compatibility with the storage portion 44A.

In addition, in a case where a still another type of toner container that is not interfered with the interference keys 99 but has a projection 88 that does not match the shape of the hole 96 of the protruding boss 94, is inserted in the storage portion 44A, the projection 88 is not inserted in the hole 96, and the tip of the projection 88 abuts on the tip of the protruding boss 94. Accordingly, in this case, too, the other type of toner container is prevented from being inserted further and being attached to the storage portion 44A. That is, in this case, too, the other type of toner container does not have attachment compatibility with the storage portion 44A.

In the present embodiment, when the toner container 41 attached to the storage portion 44A is used up and becomes empty, the empty toner container 41 (hereinafter referred to as an "empty container 41") is used in the waste toner collecting device 110.

[Waste Toner Collecting Device]

Figure 8:
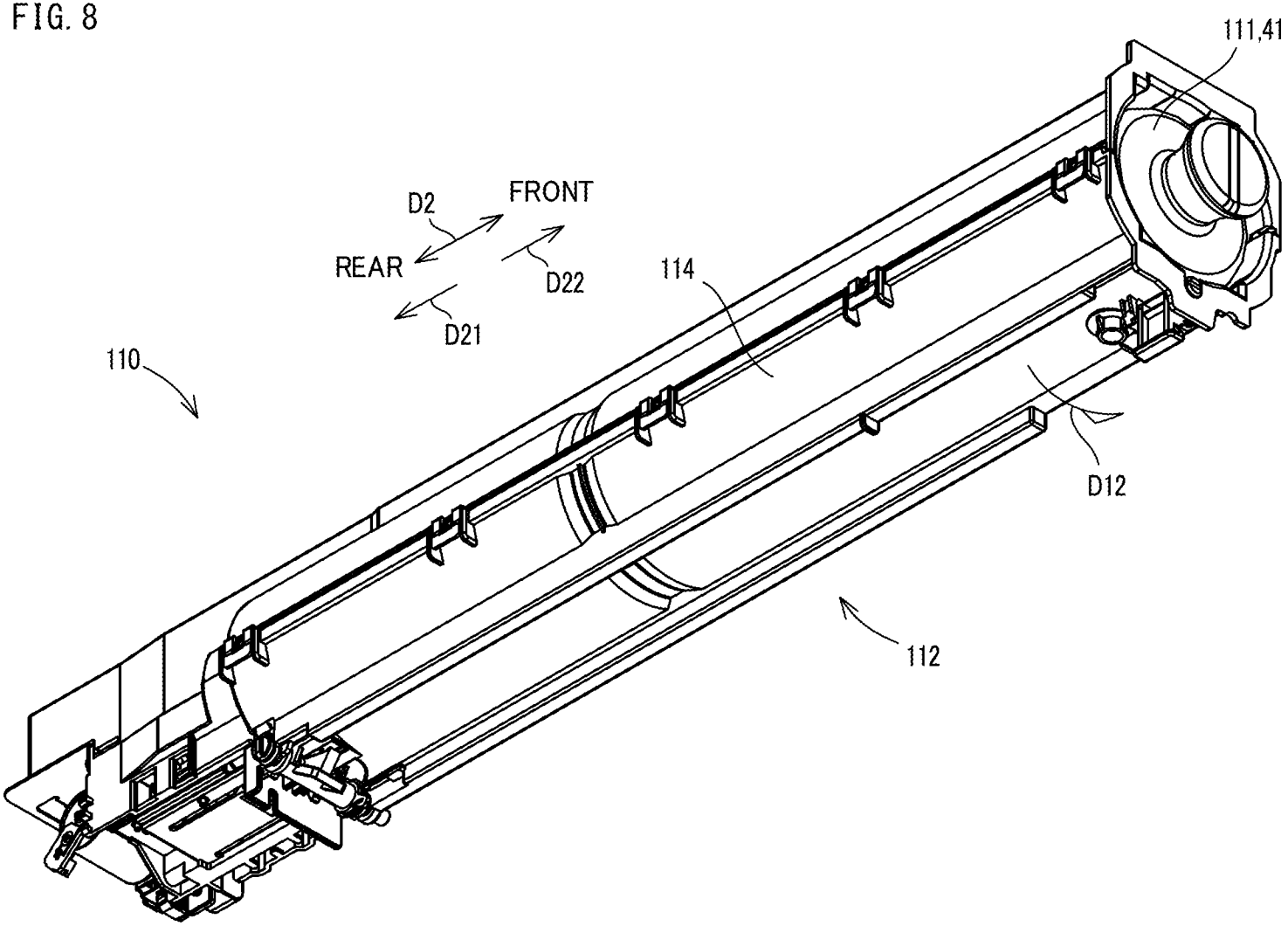
FIG. 8 is a perspective diagram of a waste toner collecting device included in the image forming apparatus.
Figure 9:
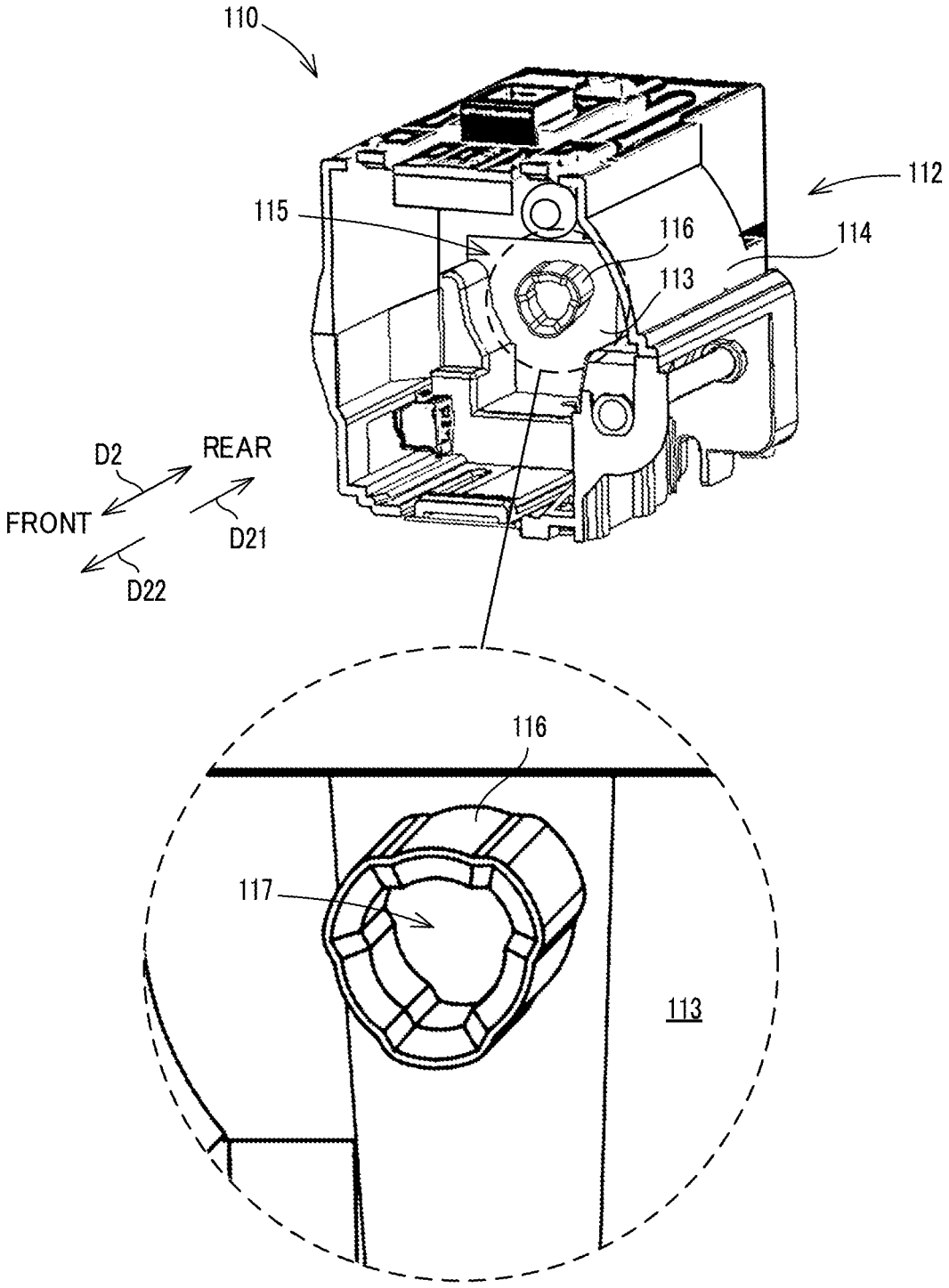
FIG. 9 is a perspective diagram of a coupled portion of the waste toner collecting device.

The following describes the waste toner collecting device 110 with reference to FIG. 8 and FIG. 9. It is noted that in FIG. 8 and FIG. 9, on the basis of the attitude in which the waste toner collecting device 110 is attached to the housing 11, the vertical direction is defined as the up-down direction D1, an attachment/detachment direction (insertion/removing direction) of the waste toner container 111 with respect to the housing 11 is defined as the front-rear direction D2, and a horizontal direction when viewed from the front of the waste toner collecting device 110 is defined as the left-right direction D3.

As shown in FIG. 8, the waste toner collecting device 110 includes the waste toner container 111 and a container attachment portion 112 to which the waste toner container 111 is attached. Here, FIG. 8 shows a state where the waste toner container 111 is attached to the waste toner collecting device 110.

The waste toner container 111 has the same shape as the toner container 41 that can be attached to the toner supply device 40. In the present embodiment, the waste toner container 111 is a used-up, empty toner container (empty container) 41 of which all the toner has been used up in the toner supply device 40. Specifically, the waste toner container 111 is a toner container 41 that had been attached to the storage portion 44A and was removed from the storage portion 44A after it had become empty with the toner therein consumed completely. The empty container 41 in the state of having been removed from the storage portion 44A can be attached to the waste toner collecting device 110. Since the waste toner container 111 has the same configuration as the toner container 41, in the following description, the same reference signs are used and the description of the configuration is omitted.

The waste toner container 111 is attached to the container attachment portion 112 in the state where the toner discharge port 74 faces up. That is, the waste toner container 111 is attached to the container attachment portion 112 in an attitude that is vertically inverted to the attitude in which the toner container 41 is attached to the container attachment portion 42. The container attachment portion 112 includes a storage portion 114 (an example of a second attachment portion of the present disclosure). The empty container 41 that had been attached to the storage portion 44A of the toner supply device 40 is attached, as the waste toner container 111, to the storage portion 114. In the present embodiment, the storage portion 114 supports the waste toner container 111 attached thereto in a detachable manner.

In a state where the waste toner container 111 is attached to a predetermined attachment position (second attachment position) in the storage portion 114 of the container attachment portion 112, a rotational driving force is transmitted to the gear 54 from a driving source such as a motor. At this time, a rotational driving force of a second rotation direction (see the arrow D12) is transmitted to the gear 54, wherein the second rotation direction is opposite to a first rotation direction (see the arrow D11) of the toner container 41. It is noted that the attachment position is set such that the toner discharged downward from the belt cleaning device 6 is received by the toner discharge port 74.

When the rotational driving force is transmitted to the gear 54, the waste toner container 111 is rotated in the second rotation direction indicated by the arrow D12. That is, after the waste toner container 111 is attached to the storage portion 114 of the container attachment portion 112, the waste toner container 111 is rotated in the second rotation direction (see the arrow D12) that is opposite to the first rotation direction, in the state where the waste toner can flow to the toner discharge port 74. This allows the waste toner stored in the waste toner container 111 to be pressed by the conveyance rib 53 and conveyed away from the outflow port 51 (frontward).

The container attachment portion 112 is configured such that the waste toner container 111 is attached thereto in a detachable manner. In the state where the waste toner container 111 is attached to the storage portion 114 of the container attachment portion 112, the container attachment portion 112 is configured to guide the waste toner discharged from the belt cleaning device 6, from the toner discharge port 74 to the inside of the waste toner container 111. The waste toner container 111 is configured to be detached from the storage portion 114 and attached to the storage portion 114 as necessary. Specifically, when the waste toner container 111 is filled with the waste toner or when the amount of waste toner stored therein becomes equal to or larger than a predetermined amount (full amount), the waste toner container 111 is removed by the user. Subsequently, an empty waste toner container 111 is attached by the user.

FIG. 9 is a perspective diagram showing a coupled portion 115 with which the coupling portion 80 of the waste toner container 111 is engaged. As shown in FIG. 9, the coupled portion 115 is provided on a depth wall 113 in the depth of the storage portion 114 on the rear side (in the insertion direction D21).

The coupled portion 115 is a member configured to be coupled with the coupling portion 80 of the waste toner container 111 inserted in the storage portion 114 in such a way as to fix the rear end portion of the waste toner container 111 and position the waste toner container 111 to a predetermined attachment position in the storage portion 114.

When the waste toner container 111 is attached to the storage portion 114 of the container attachment portion 112, the coupling portion 80 of the coupling member 56 is engaged with the coupled portion 115, and the waste toner container 111 is attached to the container attachment portion 112. The engagement of the coupling portion 80 with the coupled portion 115 restricts the coupling member 56 from pivoting in the circumferential direction of the waste toner container 111. In the state where the waste toner container 111 is attached to the storage portion 114 of the container attachment portion 112, the coupling member 56 cannot rotate in the circumferential direction, but the container main body 52 is supported in the storage portion 114 in such a way as to be pivotable in the circumferential direction.

The coupled portion 115 includes a protruding boss 116 (an example of a second engaging portion of the present disclosure). When the waste toner container 111 is attached to the storage portion 114, the protruding boss 116 is engaged with the projection 88 to position the waste toner container 111 to the predetermined attachment position in the storage portion 114. The protruding boss 116 is provided at the center of the coupled portion 115. The protruding boss 116 is a tubular member projecting frontward from the depth wall 113 of the storage portion 114. A hole 117 is formed at the center of the tip surface of the protruding boss 116. The hole 117 is formed such that the projection 88 for positioning that is provided on the end surface 59A of the coupling member 56 of the waste toner container 111, is inserted therein.

In the present embodiment, the protruding boss 116 of the coupled portion 115 is formed in a shape such that a projection of another shape provided in the coupling member 56 of not only the waste toner container 111 that matches the specification of the image forming apparatus 10, but also a waste toner container that does not match the specification of the image forming apparatus 10, can be engaged with the protruding boss 116 for positioning. That is, the protruding boss 116 is formed in a shape such that the projection 88 of the waste toner container 111 can be inserted therein, and a projection of another toner container that does not match the specification of the image forming apparatus 10 can be inserted therein.

Figure 10:
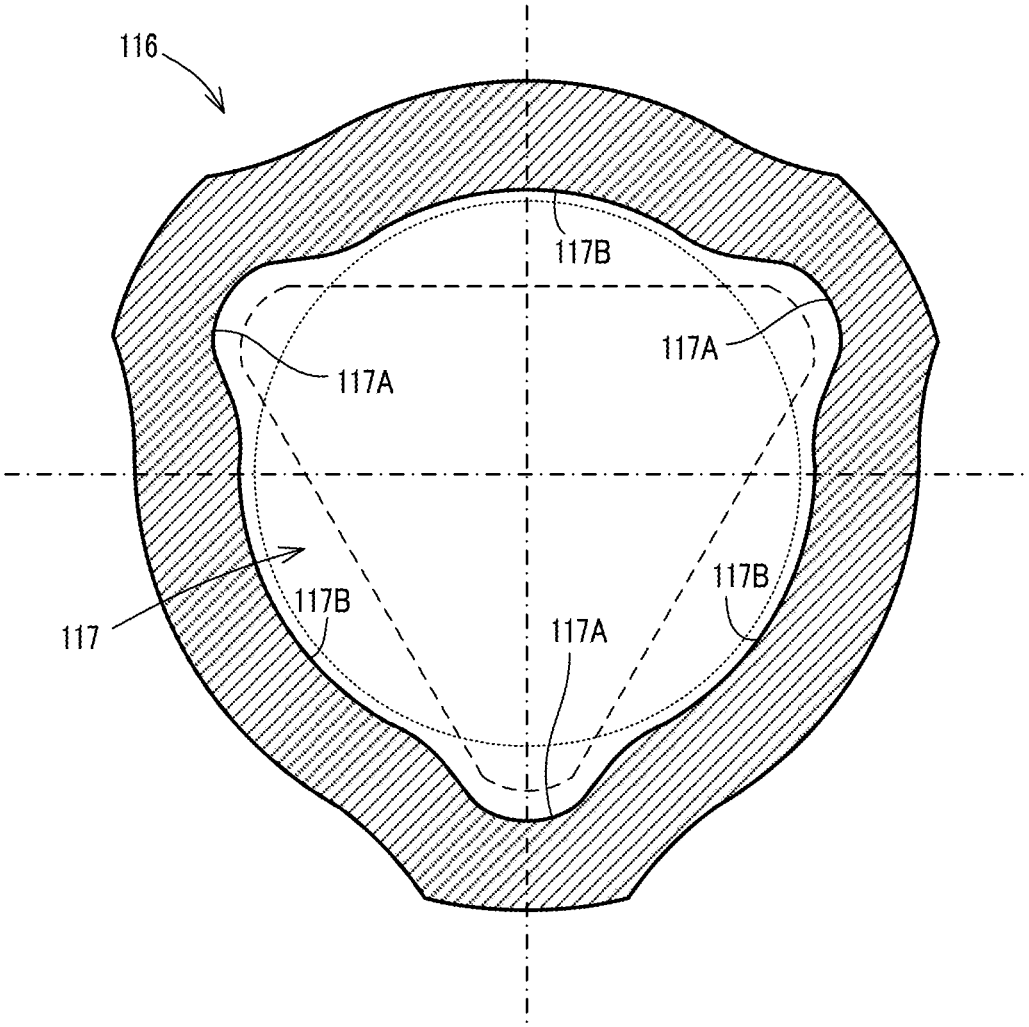
FIG. 10 is a cross-sectional diagram of a protruding boss included in the coupled portion.

FIG. 10 is a cross-section diagram of the protruding boss 116. As shown in FIG. 10, the hole 117 of the protruding boss 116 is formed such that the projection 88 (see the broken line in FIG. 10) of the waste toner container 111 and a cylindrical projection (see the dotted line in FIG. 10) provided in another waste toner container can be inserted therein. Specifically, three corner portions 117A and three arc portions 117B are formed on an inner wall of the hole 117, wherein the three corner portions 117A correspond to the three corner portions 88A of the projection 88, and the three arc portions 117B are formed to connect between the three corner portions 117A. The arc portions 117B correspond to the outer peripheral surface of the cylindrical projection provided in the other waste toner container. Accordingly, not only the projection 88 of the toner container 41 that matches the image forming apparatus 10, but also a projection of another shape (in the present embodiment, cylindrical shape) provided in another type of toner container (a mismatch container that does not match the image forming apparatus 10) can be inserted therein for positioning.

In the present embodiment, when the projection 88 is inserted in the hole 117 of the protruding boss 116, the arc-shape portions of the corner portions 88A of the projection 88 are engaged with the corner portions 117A of the inner wall of the hole 117, and the projection 88 is guided toward the depth of the hole 117. This improves the positioning accuracy of the engagement between the protruding boss 116 and the projection 88. In addition, when the cylindrical projection provided in the other type of toner container is inserted in the hole 117, the outer peripheral surface of the projection is engaged with the arc portions 117B of the inner wall of the hole 117, and the projection is guided toward the depth of the hole 117. This improves the positioning accuracy of the engagement between the protruding boss 116 and the projection.

According to conventional image forming apparatuses, the more types of toner containers there are classified into, the more compatible keys are required. In recent years, the toner containers have been divided into sub-types, and the number of types of toner containers has increased. For example, the specifications for the material of the toner, the toner storage amount, the color tone of the toner and the like are different for each environment or each country (destination) in which the image forming apparatus is used. As a result, the types of toner containers are not only classified according to the colors, but also are defined individually for the use environment or the use country. However, there is a limit to the number of compatible keys that can be provided in the conventional toner containers, and there may be a case where the compatible keys are insufficient in number for the existing types of toner containers. In addition, if the compatible keys are increased excessively, it may become impossible to attach, as a waste toner container, a used-up toner container to the waste toner collecting device.

With the above-described configuration, the image forming apparatus 10 of the present embodiment has an increased number of incompatibility structures to be identified in correspondence with the plurality of types of toner containers 41. In addition, according to the image forming apparatus 10 of the present embodiment, a used-up toner container 41 can be easily attached to the waste toner collecting device 110.

Specifically, in the image forming apparatus 10 of the present embodiment, the projection 88 and the protruding boss 94 are formed in the shapes such that the toner containers 41 of the types corresponding to the storage portions 44 can be selectively attached thereto. In addition, the protruding boss 116 is formed in a shape such that the projection 88 of not only the waste toner container 111 that is a used-up toner container 41 (the empty container 41), but also an empty container 41 of another type of toner container, can be engaged with the protruding boss 116. As a result, by combining the existing compatible keys 81 and interference keys 99, and the projection 88 and the protruding boss 94, it is possible to increase the number of incompatibility structures that can be identified in correspondence with the plurality of types of toner containers 41, without increasing the number of existing compatible keys 81 or the like. In addition, in a case where a used-up toner container 41 (empty container 41) is attached, as the waste toner container 111, to the waste toner collecting device 110, any type of empty container 41 can be attached to the waste toner collecting device 110. Accordingly, there is no need for the protruding boss 116 in the waste toner collecting device 110 to have a shape that is different for each type of empty container 41, and the protruding boss 116 can be used in common to the various types of empty containers 41.

In the above-described embodiment, the protruding boss 116 is formed such that the corner portions 117A and the arc portions 117B are included in the inner wall of the hole 117. However, the present disclosure is not limited to the configuration. For example, the protruding boss 116 may be formed in the shape of a circle of the radius R2 in cross section such that the projection 88 can be inserted in the protruding boss 116. That is, the protruding boss 116 may be a tubular member having a hole in the shape of a circle of the radius R2. With this configuration, not only the projection 88 of the toner container 41 that matches the image forming apparatus 10, but also a projection of another shape provided in another type of toner container (a mismatch container that does not match the image forming apparatus 10) can be inserted therein for positioning. In this case, when the projection 88 is inserted in the hole 117 of the protruding boss 116, the arc-shaped portions of the corner portions 88A of the projection 88 slide on the inner peripheral surface of the hole 117. This improves the positioning accuracy of the engagement between the protruding boss 116 and the projection 88. In addition, when the projection of another shape (for example, a pentagonal prism-like shape, or a cylindrical shape) provided in another type of toner container is inserted in the hole 117, the outer peripheral surface of the projection slides on the inner wall of the hole 117, and the projection is guided toward the depth of the hole 117. This improves the positioning accuracy of the engagement between the protruding boss 116 and the projection.

In addition, in the above-described embodiment, the projections 88 and the protruding bosses 94 are formed in a shape such that the toner containers 41 are selectively attached to the corresponding storage portions 44 of the image forming apparatus 10. However, the present disclosure is not limited to the configuration. For example, in a case where the toner container 41A for black is formed in such a way as to be attached only to the storage portion 44A, the projection 88 and the protruding boss 94 may be formed in a shape such that the toner container 41A can be selectively attached to the storage portion 44A of the image forming apparatus 10.

In addition, in the above-described embodiment, the projection 88 is formed in the shape of a triangular prism in which the corner portions 88A are formed in the shape of an arc. However, the projection 88 of the present disclosure is not limited to the configuration. For example, the corner portions 88A may be formed in a non-circular shape such as a triangular prism-like shape. In addition, the projection 88 may be a columnar member of a polygonal shape having an odd number of corner portions.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a toner supplying portion including a first attachment portion that supports, in an attachable and detachable manner, a toner container at a predetermined first attachment position; and a waste toner collecting portion including a second attachment portion that supports, in an attachable and detachable manner, the toner container at a predetermined second attachment position, wherein the toner container includes:

a positioning member configured to, by being engaged with the first attachment portion that corresponds to a type of the toner container, position the toner container to the first attachment position of the first attachment portion; and a compatible key provided at a position corresponding to the type of the toner container and configured to allow the toner container to be selectively attached to the first attachment portion, the first attachment portion includes:

a first engaging portion configured to position the toner container to the first attachment position by being engaged with the positioning member of the toner container, the second attachment portion includes:

a second engaging portion configured to position the toner container to the second attachment position by being engaged with the positioning member of the toner container, the first engaging portion and the positioning member are formed in a shape that allows the toner container of the type corresponding to the first attachment portion to be selectively attached to the first attachment portion, and the second engaging portion is formed in a shape that allows the positioning member to be engaged with a toner container of any one of a plurality of types.

2. The image forming apparatus according to claim 1, wherein each of the first attachment portion and the second attachment portion is configured to support the toner container that is inserted toward a predetermined attachment position, the positioning member is a protruding member that protrudes, in an insertion direction of the toner container, from a tip portion of the toner container in the insertion direction, and each of the first engaging portion and the second engaging portion is a tubular member in which the positioning member is inserted.

3. The image forming apparatus according to claim 2, wherein the second engaging portion is formed in a shape of a cylinder having a predetermined inner diameter, and the positioning member is formed in a non-cylindrical shape, and an outer peripheral portion of a maximum radius portion of the positioning member slides on an inner peripheral surface of the second engaging portion.

4. The image forming apparatus according to claim 3, wherein the outer peripheral portion of the maximum radius portion of the positioning member is formed in an arc shape in such a way as to slide on the inner peripheral surface of the second engaging portion.

* * * * *